US007689348B2

(12) United States Patent
Boss et al.

(10) Patent No.: US 7,689,348 B2
(45) Date of Patent: Mar. 30, 2010

(54) INTELLIGENT REDIRECTION OF VEHICULAR TRAFFIC DUE TO CONGESTION AND REAL-TIME PERFORMANCE METRICS

(75) Inventors: Gregory Jensen Boss, American Fork, UT (US); Rick Allen Hamilton, II, Charlottesville, VA (US); John Steven Langford, Austin, TX (US); Timothy Moffett Waters, Hiram, GA (US)

(73) Assignee: International Business Machines Corporation, Armonk, NY (US)

( * ) Notice: Subject to any disclaimer, the term of this patent is extended or adjusted under 35 U.S.C. 154(b) by 825 days.

(21) Appl. No.: 11/379,075

(22) Filed: Apr. 18, 2006

(65) Prior Publication Data

US 2007/0244627 A1 Oct. 18, 2007

(51) Int. Cl.
*G08G 1/00* (2006.01)

(52) U.S. Cl. ..... 701/117; 340/907

(58) Field of Classification Search ..... 701/117, 701/118; 340/907, 909, 816, 923, 932; 104/88.02
See application file for complete search history.

(56) References Cited

U.S. PATENT DOCUMENTS 5,648,904 A * 7/1997 Scott ..... 701/117
6,633,238 B2 10/2003 Lemelson et al.
6,785,606 B2 * 8/2004 DeKock et al. ..... 701/117
6,909,380 B2 6/2005 Brooke
7,319,931 B2 * 1/2008 Uyeki et al. ..... 701/209
2001/0029425 A1 10/2001 Myr
2006/0122846 A1 * 6/2006 Burr et al. ..... 705/1

OTHER PUBLICATIONS

Privacy International; PHR-2004—Japan; Nov. 16, 2004; 10 pages.
RFID Gazette; Radio Frequency Identification news and commentary; Aug. 18, 2005; RFID-Tagged License Plates to be Unveiled in UK; 1 page.
Dr Peter Harrop; Active RFID and its Big Future; IDtechEx Ltd 2004; 10 pages.
C. K. Toth, D. G-Brzezinska, C. Merry; Supporting Traffic Flow Management With High-Definition Imagery; ipi Workshop 2003, Germany, Leibniz Universtät, Hannover. 6 pages.

* cited by examiner

*Primary Examiner*—Dalena Tran
(74) *Attorney, Agent, or Firm*—Darcell Walker; William H. Steinberg; Schmeiser, Olsen & Watts

(57) ABSTRACT

An automated traffic control system provides real time alternative traffic flow solutions to address traffic congestion on a roadway. A process will pick routes to scan for real-time statistics on the traffic conditions and calculate an average vehicle speed (AVS) for that route, road, highway, etc. If the AVS drops below a historical threshold, a decision matrix is created, whereby all the real-time data is compared with historical data and provides an ideal or best alternative route for "route X". The operator is provided this information within seconds and is allowed to make a decision to "accept or decline" the proposed changes in routes. If the proposed changes are accepted, the changes begin to occur automatically such as but not limited to updating electronic signage, changing traffic control signals (all green to keep traffic moving), moving electronic barriers, etc.

6 Claims, 5 Drawing Sheets

INTELLIGENT REDIRECTION OF VEHICULAR TRAFFIC DUE TO CONGESTION AND REAL-TIME PERFORMANCE METRICS

FIELD OF THE INVENTION

This invention relates to a method and system for improving the traffic flow of a route when traffic congestion has developed on that route and in particular to a method and system for automatic detection of traffic congestion on a route and intelligent redirection of vehicular traffic on that route in response to the congestion.

BACKGROUND OF THE INVENTION

Vehicular traffic congestion is the bother of the modern commuter and a potent poison of the rational mind. Traffic congestion results in high drains on national economics, as otherwise productive persons are frequently forced to endure long, unproductive delays. Not only does it cause delays and frazzled nerves, but traffic congestion also pollutes the air and wastes precious energy resources (gasoline).

Numerous methods exist to dynamically alter traffic flow to minimize traffic congestion and/or to mitigate its effects. All of these methods involve three basic steps: 1) recognizing congestion or potential congestion; 2) determining a corrective action and based on that, 3) altering the traffic flow (perhaps by simply changing the display of an electronic street sign or it appropriate, by moving physical lane barriers).

In one scenario, during the morning rush hour, one a particular roadway, traffic is heavy in one direction and in the evening rush hour traffic is heavy in the opposite direction. Typically, in this situation, traffic engineers make the recognition and determination steps beforehand. It is seen that these congestion patterns normally occur at the same time each day so timers are utilized to trigger the altering of the traffic flow. Using timers relies on the assumption that the traffic patterns remain consistent.

In a second scenario, major city intersections sometimes have real people stationed to manually direct traffic. This approach is a fairly reliable system, however there are some drawbacks. It, obviously, requires real people, which can be expensive. It subjects them to physical risk and (like every human endeavor) is prone to "user error".

In a third scenario, major intersections may be visually monitored from remote "traffic control centers". This solution is similar to the previous example, but has its own set of benefits and drawbacks. The "awareness" of sudden changes in conditions may be more apparent to someone who is physically there or perhaps not. Regardless, with this approach there is still the expense and potential "user error" associated with humans.

All of these systems are manual, involve human input and are prone to errors. It would be advantageous to have an automated control system that was dynamic in nature and would react to actual conditions.

SUMMARY OF THE INVENTION

It is an objective of the present invention to provide a method and system to reduce vehicular traffic congestion on roadways.

It is a second objective of the present invention to provide a method and system that automatically detects traffic congestion on a roadway and calculate an alternate traffic route to avoid the roadway congestion.

It a third objective of the present invention to develop a traffic collection database that contains information about the various traffic and weather conditions that impact the flow of traffic on a roadway.

It is a fourth objective of the present invention to provide a decision matrix that can calculate alternate traffic routes in response to the detection of traffic congestion on a roadway, the calculation being based on the traffic and/or weather conditions at the location of the detected roadway congestion.

It is a fifth objective of the present invention to provide a plurality of monitors that can detect traffic conditions and traffic congestion at a specific location of a roadway.

The present invention provides a system that is programmed to automatically detect traffic congestion on a roadway and calculate an alternate route for drivers to take in order to avoid the detected congestion. The system comprises a traffic monitor device positioned at a known location on a roadway, a traffic data collection database, and software within the monitor device that can calculate alternate traffic routes to a congested roadway. The invention further comprises various sensors and sources that supply information to the monitor device and software in the monitor device.

In the method of the present invention data is collected that conveys information about the traffic conditions at a location on a roadway. This data may come from many different sources such as pressure sensitive strips crossing the lanes, overhead or buried mass sensors, light beams and other similar devices. The data is collected in a traffic collection database. Regardless of the nature of the data, it can be programmatically interpreted so that corrective action can be taken when congestion is detected at a location. The data being collected includes information about the state of the traffic such as: traffic flow rate, number of vehicles, absolute and relative vehicle speed, existing routes, construction detours, weather conditions, etcetera. The choice of corrective action could be decided beforehand for every possible set of conditions and compiled into a decision database. When the monitor detects congestion on a roadway where that monitor is positioned, the software program retrieves information from the collection data related to traffic and/or weather conditions on that roadway. This information is used to calculate an alternative solution to reduce traffic congestion in the area. This calculated alternate solution would be submitted to traffic control personnel who could accept the solution or reject the solution. When the calculated alternative is accepted, the appropriate traffic personnel implement this alternate plan.

DESCRIPTION OF THE INVENTION

DESCRIPTION OF THE INVENTION

The present invention provides a method and system to automatically calculate and implement alternative traffic routes to avoid congestion on a roadway. The types of roadways can vary from major freeways to main streets of a large city or community. In the implementation of the present invention, monitors are placed at various locations on a roadway. These monitors contain a means to gather information about the conditions of the roadway. Different types of input data can include but are not limited to the following:

Axle count—pressure strips

Body count—photo sensors, mass sensors, vehicle RFID tags

Speed—Doppler radar, microwave, etc.

Construction information—DOT reports, local news, etc.

Weather conditions—NWS, NOAA, etc.

Emergency conditions—Local FD and PD communication channels.

In addition, the monitor can detect the average vehicle speed of vehicles passing through that location. The monitor also has the ability to communicate with and receive information from a central traffic database.

Figure 1:
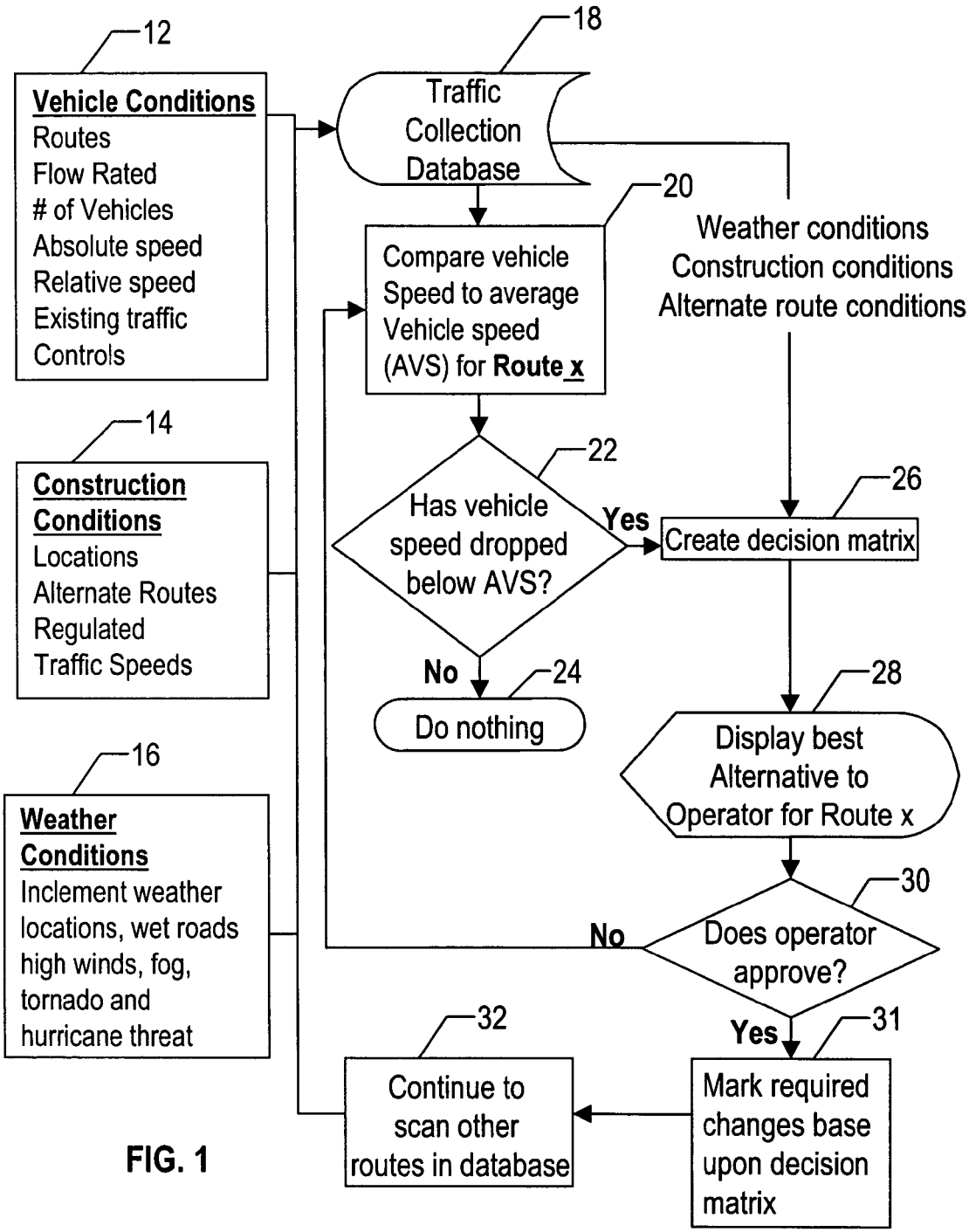
FIG. 1 is a flow diagram of the method of the present invention for calculating alternative travel routes

Referring to FIG. 1, shown is a configuration of the implementation of the present invention. As illustrated, there are a variety of conditions that can affect the flow of traffic on a roadway. One set conditions are vehicle conditions, which are directly related to the motor vehicles traveling on the roadway. These conditions include the size of the roadway. Some roadways may consist of multiple lines in each direction. There may be two lanes for traffic in each direction. Other roadways can have multiple lanes going only one way. The size of the roadway can influence the flow rate of the vehicles. This flow rate or speed is another important vehicle condition that impacts traffic. A third vehicle condition is the number of vehicles on a particular segment of the roadway at one time. An addition condition is the absolute or posted speed which cars are allowed to travel on that roadway.

A second type of condition is road construction conditions. The information related to road construction includes the location of the construction, alternate or detour traffic routes around the construction area, the length or distance of the construction area and regulated traffic speeds for that roadway in the construction area. A third set of conditions that can impact traffic flow are weather conditions. These conditions include inclement weather such as heavy rain, wet roads, high wind, high water, fog, tornados and threat of hurricanes.

Figure 5:
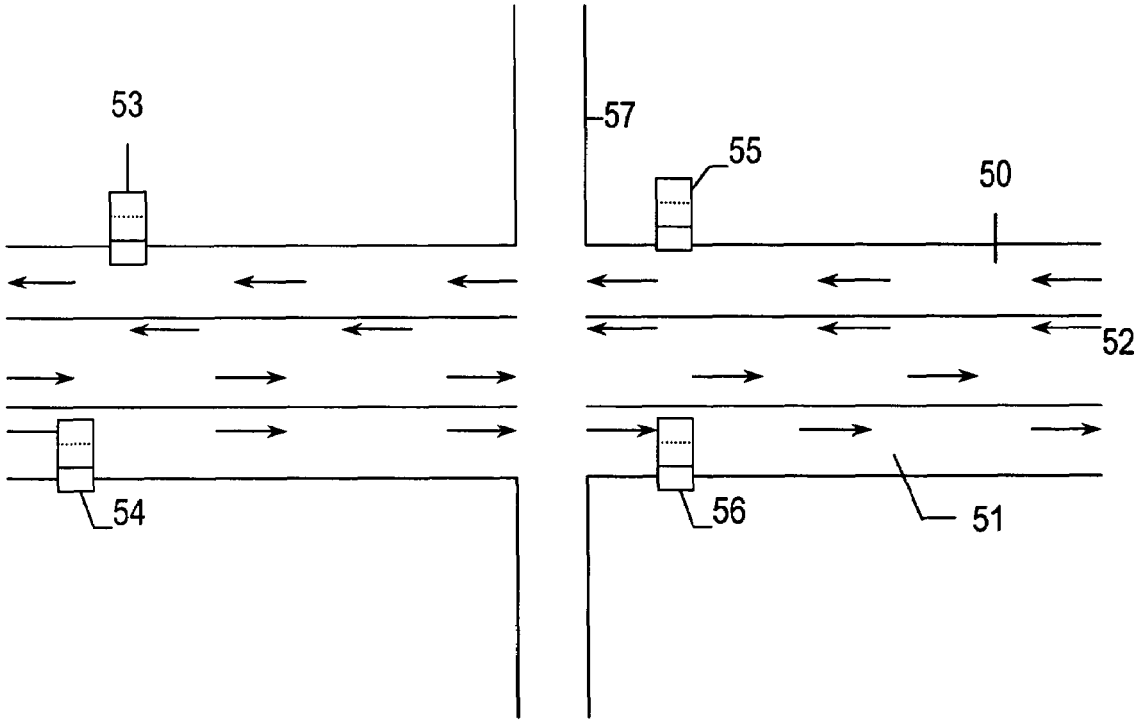
FIG. 5 is an example of a roadway on which the method and system of the present invention can be implemented.
Figure 6:
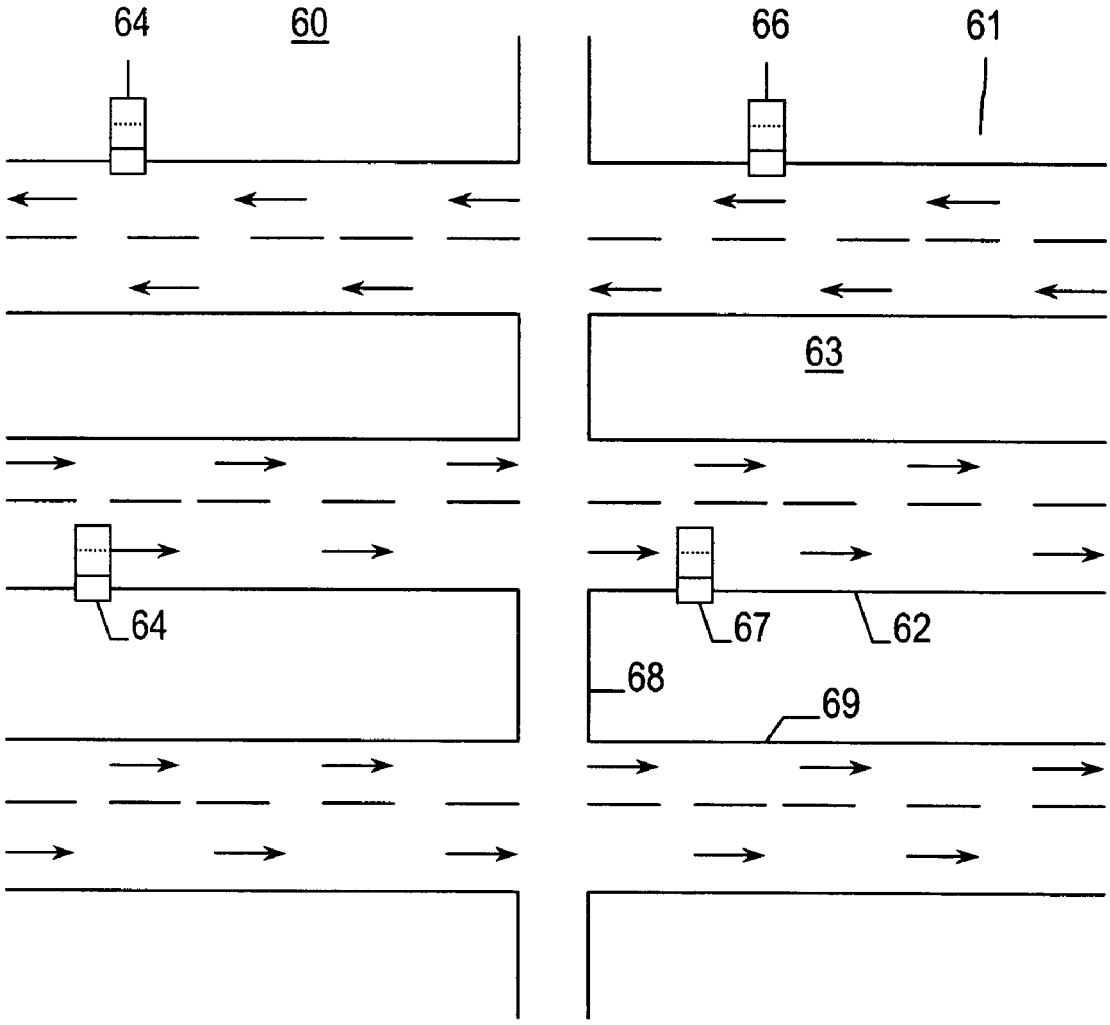
FIG. 6 is an example of a roadway on which the method and system of the present invention can be implemented.

Referring again to FIG. 1, vehicle condition inputs 12, construction condition inputs 14 and weather condition inputs 16 for a particular roadway location are collected and stored in the traffic collection database 18. The traffic database also contains information from other roadway locations in a manner similar to traffic control centers currently found in many large cities. This central database can be located at a central traffic control center. The database contains selected roadways where monitors are located. Each monitor has an entry in the database with information that is unique for that monitor. For example, the monitor information will include the number of lanes on the roadway, whether the roadway is a freeway, a major street or a one-way street. The information can also contain locations of intersections and locations of other streets in the proximate location of the monitor and the sizes and directions of those streets. As will be discussed later, FIGS. 5 and 6 give illustrations of the different conditions for various monitor locations. The database can also contain information from the local traffic control system similar to those that many metropolitan areas have.

In the implementation of the invention, a monitor positioned on the roadway monitors the average vehicle speed (AVS) of vehicles on the roadway. Traffic would be considered "congested" when the AVS drops below a certain threshold. If possible, it is desirable for the AVS to be measured directly, e.g. using radar or Doppler. If direct measurements are not used, the AVS can be calculated from the input data of other devices such as double pressure strips: Those ubiquitous black rubber hoses that cross our nation's streets and roads, if placed in pairs at a known distance apart, can be used to calculate AVS. Body count data can be used in two ways. The sensors can be placed in pairs, like the pressure strips above. The length of time for an average vehicle passing by can be used in conjunction with an "average" vehicle length to calculate the AVS. The AVS (either calculated or measured directly) will be for a specific point on the road at a specific time. This information is real-time in nature and can therefore be used to predict follow-on congestion and perhaps reroute traffic to avert it.

In block 20, after the calculation of the AVS, this average vehicle speed is compared to a predetermined speed for that roadway. The predetermined speed for that roadway could be the posted roadway speed or a threshold speed that is lower than the posted speed. For example, the posted speed could be 35 mph. For most city streets regardless of size, this speed is typical. The threshold speed could be 15 mph. If the vehicles are traveling below this speed, it may be logical to conclude that something is affecting the flow of traffic on this street and is causing traffic congestion at that location. If the comparison results in a determination that the AVS is not below the threshold speed, shown in block 22, nothing happens as shown in block 24. The determination at this point is that any slowdown in traffic flow is not sufficient enough to trigger an automatic alteration traffic flow. At this point, the process returns to block 20 where the traffic flow monitoring and AVS calculations continue.

Figure 3:
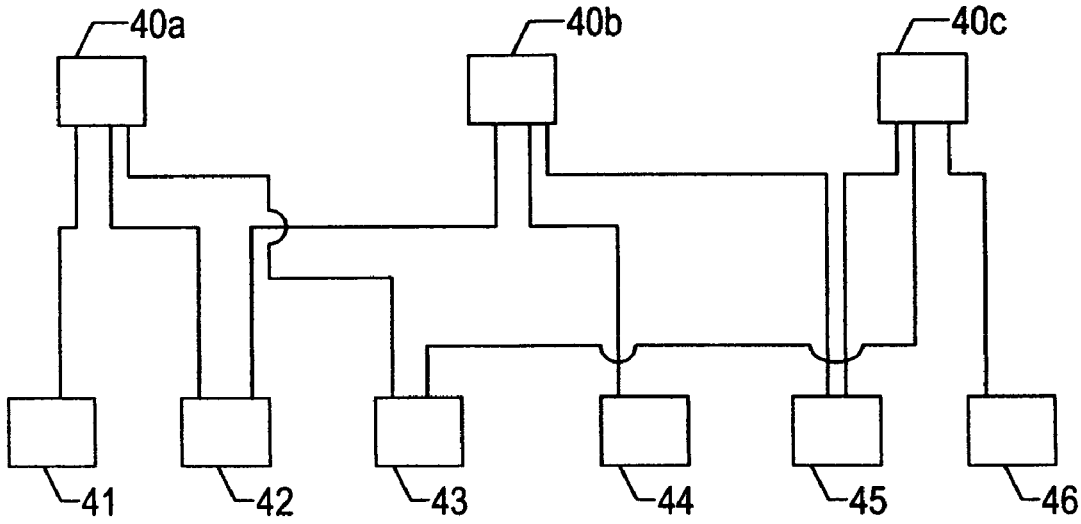
FIG. 3 is an example of decision matrix for calculating alternative routes to avoid congestion.
Figure 4:
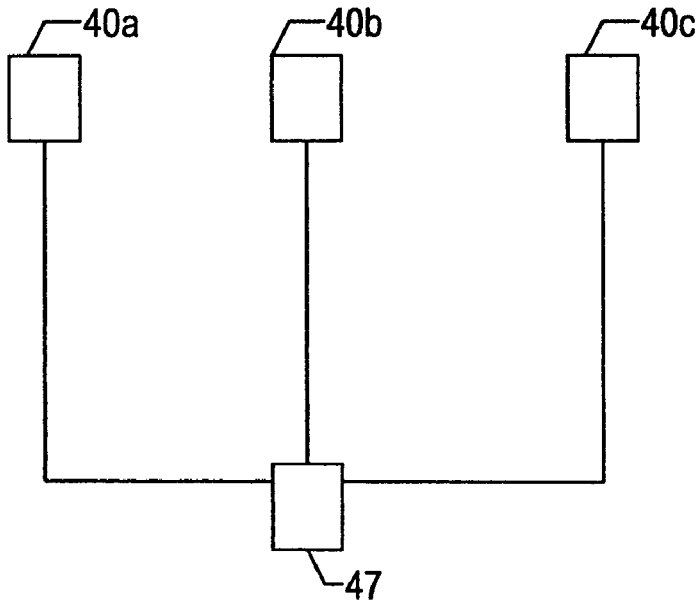
FIG. 4 is an example of a decision matrix for calculating an alternative route to avoid congestion using inputs related to vehicle conditions, road construction conditions and weather conditions.

Referring back to block 22, if the determination is that AVS has dropped below the threshold speed, the process moves to block 26, which creates an alternate traffic flow configuration to address the traffic congestion problem. This alternate traffic flow configuration is created using a decision matrix. FIGS. 3 and 4 are illustrations of a decision matrix that can be implemented in the present invention. Once the decision matrix has produced an alternate route or solution for the congestion, block 28 displays this solution to an operator assigned for the route/roadway that has the congestion. In block 30, the operator makes a decision whether to approve or reject the solution. With regard to the produced alternative, the decision matrix can produce multiple alternatives that can address the traffic congestion. The operator can reject each alternative or can pick one of the proposed alternatives for implementation.

Figure 2:
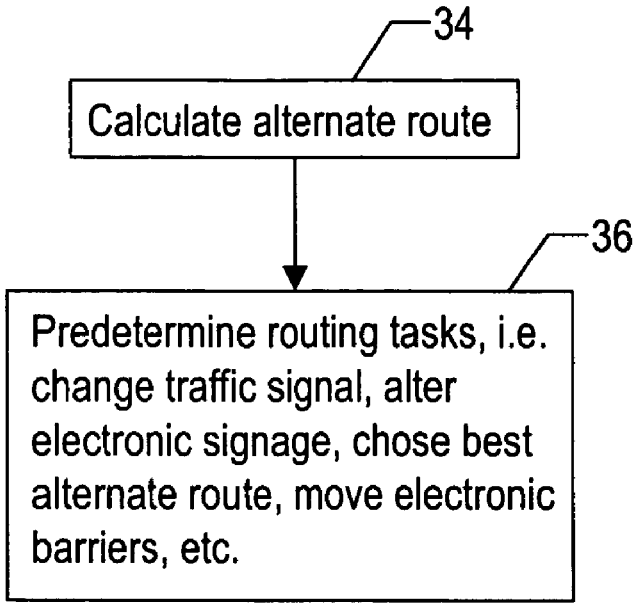
FIG. 2 is a detailed flow diagram of the decision matrix step of the present invention.

FIG. 2 illustrates the process for determining the solutions for the different combinations of conditions detected during congestion at a roadway location. The primary solution to roadway congestion is to generate an alternate route for vehicles to travel to avoid and/or reduce the number of vehicles in that congested location. In this process, step 34 calculates one or more alternate routes. These alternate routes may be predetermined and placed in the decision matrix in one of the solution boxes. Once there has been at least one alternate route identified, step 36 determines the logistics necessary to implement this alternate route or other alternate solution. During this step, tasks are identified that must be performed in order to implement this alternate route or solution. These tasks for consideration include determining whether signs need to be changed, electronic signage that needs to be changed or electronic barriers that need to be removed or put in place.

If the operator approves a proposed alternative, the requirements to implement the traffic configuration change are marked in block 30. As part of this process, any traffic signals affected by the alternate configuration are changed as needed and any signage is changed as needed as indicated in block 31. In some instances, there may be electronic barriers that may be operated to restrict use of certain lanes or to open up lanes for vehicle use that were previously unavailable. Time has to be allowed in order for the reconfiguration to happen without accidents in the process. For example, some reconfigurations may require the change in direction of traffic in a particular line. There may be an interval such five minutes during this reconfiguration when no traffic will be allowed to travel in that lane in order to clear out any present traffic in that lane when the reconfiguration began. Once the reconfiguration is complete, the process of scanning routes continues in blocks 32 and 20.

Referring to the decision matrix block 20, FIG. 3 gives an illustration of decision matrix for a roadway monitor. Blocks 40*a*, 40*b* and 40*c* represent input data from three major conditions that impact roadway traffic flow. As previously described, these conditions are vehicles conditions 40*a*, construction conditions 40*b* and weather conditions 40*c*. In the matrix, each condition individually or in combination with another condition can cause traffic congestion. For each separate or joint condition that is present when a congestion condition is detected on a roadway, there can be generally predetermined solutions. Blocks 41, 42, 43, 44, 45, and 46 represent traffic flow solution when a certain condition or conditions is present during traffic congestion. Solution 41 is only when vehicle conditions cause the congestion. Solution 42 results from congestion cause by vehicle and construction conditions. Solution 43 is the result from vehicle and weather conditions. Solution 44 results when road construction conditions are creating roadway congestion. Solution 45 is the result of a combination of construction conditions and weather conditions. Solution 46 is the result when only weather conditions are causing the congestion. For a particular roadway location, the solution for the condition(s) causing the congestion may be different from the solution in another roadway location for the same conditions. In addition, referring to FIG. 4, if all three conditions 40*a*, 40*b*, and 40*c* are present when congestion is detected, there could be one determined solution 47. Again, this solution 47 would be different for each roadway location based on the configuration of the roadway at that location.

FIG. 5 illustrates an application of the present invention to a roadway. In this application, as shown the roadway is a typical three lane road having lanes 50 and 51 going in opposite directions and a center lane 52 that is used for making left turns. In addition, the center lane is bidirectional lane that can serve as a second lane in either direction to reduce congestion when the traffic flow is a particular direction is much heavier. This situation develops during morning and afternoon rush hours. For example, lane 50 could be a westbound lane and lane 51 could be an eastbound lane. The speed limit for this roadway is 35 mph. During weekdays, when traffic is heavy in the eastbound direction during the morning rush hour, the center lane is solely an eastbound lane for a specific period of time such as 6:30 am to 9:30 am. In the afternoon, the center lane 52 would be a westbound lane from 3:30 pm to 6:30 pm. Signs and electronic indicate this pattern.

With reference to the present invention, traffic monitors 53, 54, 55 and 56 can be placed at certain physical location along the street. Depending on the size of the street the distance between monitors could vary. In addition, there can be road sensors positioned at various locations along to the roadway to sense traffic speed at locations other than the location of the monitor. The present example has monitors that are dedicated to monitoring traffic in only one direction, however, there can be single monitors positioned on a street that have the capabilities to monitor traffic flow in both directions from one side of the street. In this second configuration, relying one a single monitor for traffic in both direction, there would be more reliance on traffic sensors and adaptable software within the monitor. Also shown is an intersection wherein a cross 57 could serve as an alternate route.

Although traffic patterns during the weekday rush hours are established, a condition could develop during the day or on the week when the center lane is used solely for a turn lane. For example, an accident occurs on a Saturday in the westbound lane 50. Because this is not a weekday, the center lane 52 is strictly a turn lane. The accident begins to cause the westbound traffic to become congested. As the congestion grows the AVS for traffic in that lane in the approximately location of the accident begins to drop. If the AVS drops below a defined threshold speed of 10 mph, this suggests that the accident is causing significant congestion. At this point, block 26 of the software program is activated to calculate a solution to this congestion problem. The software program in the monitor would use the configuration matrix information along with information received from the central data in determining the solution. The central database which receives information from varies sources could possibly identify the actual location of the accident with regard to the location of the monitor. One such source are sensors positioned at various locations along the roadway can also feed information to the monitor such that the monitor can estimate the approximate location of the accident that is causing the congestion. The ability to identify an approximate location of the cause of the congestion can enable the system of the present invention to better determine how to address the slowdown. When the monitor detects the slowdown, the monitor could send an inquiry to the central database to get information on the location of the accident. Referring to the matrix configuration in FIG. 3, this condition would fall under solution 41. The solution to this accident could be to make the center lane 52 a solely westbound lane to allow traffic move passed the accident. This solution would go the operator at the central control for acceptance. The operator should have additional information in the central control location that tells the operator the location of the accident and the extent of the congestion. Based on this information, the operator may accept or reject the solution. One reason the operator may reject the solution is that the extent of the congestion is small maybe just in the immediate vicinity of the monitor, if the accident at a location very close to the monitor. In another case, the accident may be minor and may be quickly cleared. The accident could be cleared by the time it requires to put the alternate solution into affect. If the operator accepts the solution (a major accident has occurred), the solution is then activated by the system of the present invention. When this solution is activated, the electronic signs usually used during weekday rush hour to signal that lane 52 is a one-way westbound lane would be in affect. Information from the central control could give the monitor software information about the length of the roadway that would be affected by this solution. Unlike a typical weekday rush hour, the length of the roadway affected by this alternative solution could vary.

FIG. 5 showed an implementation of the present invention that modified the traffic flow on a single roadway in response to an accident on that roadway. Figure is an implementation of the present invention when congestion on a roadway produces a solution that requires the detouring of traffic to an alternate roadway. As shown, there is a major roadway 60 that has multiple lanes 61 and 62 going in each direction. These lanes can be physically separated by a medium 63. Monitors 64, 65, 66, and 67 are positioned at locations along this roadway. A second roadway 68 intersects roadway 60. This second roadway leads to a third roadway 69 that runs in the same direction as roadway 60. As with the previous example, when some condition has developed that causes the AVS on the roadway 60 to fall below a predetermined threshold speed, alternative solutions can be developed to reduce the congestion on that roadway. In example, if the cause of the congestion was east of the intersection in the eastbound direction 62, a solution could be detour traffic down roadway 68 to roadway 69 and eastbound on roadway 69. In the implementation of this solution, the right lane 62*b* could become a right turn only lane at the intersection with roadway 68. This right turn only solution would detour vehicles in the right lane off of roadway 60 down to roadway 69. Notice that this solution would only be for eastbound traffic when the cause of the congestion is east of the intersection. A scenario such as this one could be anticipated and included in the decision matrix for that monitor.

In the example for FIG. 6, monitor 67 would be the mostly likely to detect the congestion in this example. If the congestion is extensive, monitor 66 may also detect some AVS slowdown. The present invention can have an embodiment in which monitors can be communication with adjacent monitors. In this example, monitors 66 and 67 can communicate with each other and the central traffic database, if this condition causes congestion to extend the length between the two monitors.

The resulting programmatic traffic control system would have the positive characteristics described in the examples above while avoiding the expense, risk and errors associated with human controllers. It would also offer the opportunity to actively mitigate further congestion. The intention of the system is to enhance existing traffic control systems. The system described herein will prepare the decision matrix automatically, but allow the traffic controllers the required adjudication or change management control over the overall arterial traffic system.

It is important to note that while the present invention has been described in the context of a fully functioning data processing system, those skilled in the art will appreciate that the processes of the present invention are capable of being distributed in the form of instructions in a computer readable medium and a variety of other forms, regardless of the particular type of medium used to carry out the distribution. Examples of computer readable media include media such as EPROM, ROM, tape, paper, floppy disc, hard disk drive, RAM, and CD-ROMs and transmission-type of media, such as digital and analog communications links.

We claim:

1. A method for intelligent redirection of vehicular traffic in response to roadway congestion comprising the steps of:

collecting and storing inputs for vehicle condition, construction condition and weather conditions for a particular roadway location in the traffic collection database;

creating a decision matrix comprising a set of general roadway conditions and a set of solutions for the set of roadway conditions, wherein each combination of roadway conditions has a solution;

monitoring vehicle speed of vehicles traveling on a roadway and passing a detection device positioned on the roadway;

determining whether traffic conditions have dropped below an average vehicle speed by calculating average vehicle speed of vehicles traveling on the roadway and comparing the calculated average vehicle speed with a previously defined threshold speed;

retrieving roadway characteristics information and information about conditions on the roadway from a central database when the calculated average vehicle speed is below the threshold speed;

automatically generating an action plan to reduce congestion on the roadway based on roadway characteristics and roadway conditions, by creating an alternate traffic flow configuration by changing the flow direction of particular lanes of roadway through a decision matrix, the decision matrix having a set of one or more condition inputs that describe factors that can cause congestion of traffic flow and a set of solutions which are corrective actions to implement to reduce the caused traffic congestion;

submitting the generated action plan to an operator for approval;

receiving a response for the submitted action plan; and implementing the generated action plan when the received response was an approval of the generated action plan.

2. The method as described in claim 1 wherein said implementing step further comprises determining an equipment configuration of roadway equipment to display information and instructions to direct motorists in alternative traffic routes to avoid congestion on the roadway on which the vehicles are traveling.

3. The method as described in claim 2 wherein said implementing step further comprises automatically switching roadway equipment to direct motorists in alternative traffic routes to avoid congestion on the roadway on which the vehicles are traveling.

4. A computer program product in a computer readable storage medium for intelligent redirection of vehicular traffic in response to roadway congestion comprising:

instructions collecting and storing inputs for vehicle condition, construction condition and weather conditions for a particular roadway location in the traffic collection database;

instructions creating a decision matrix comprising a set of general roadway conditions and a set of solutions for the set of roadway conditions, wherein each combination of roadway conditions has a solution;

instructions monitoring vehicle speed of vehicles traveling on a roadway and passing a detection device positioned on the roadway;

instructions determining whether traffic conditions have dropped below an average vehicle speed by calculating average vehicle speed of vehicles traveling on the roadway and comparing the calculated average vehicle speed with a previously defined threshold speed;

instructions retrieving roadway characteristics information and information about conditions on the roadway from a central database when the calculated average vehicle speed is below the threshold speed;

instructions automatically generating an action plan to reduce congestion on the roadway based on roadway characteristics and roadway conditions, by creating an alternate traffic flow configuration by changing the flow direction of particular lanes of roadway through a decision matrix, the decision matrix having a set of one or more condition inputs that describe factors that can cause congestion of traffic flow and a set of solutions which are corrective actions to implement to reduce the caused traffic congestion;

instructions submitting the generated action plan to an operator for approval;

instructions receiving a response for the submitted action plan; and instructions implementing the generated action plan when the received response was an approval of the generated action plan.

5. The computer program product as described in claim 4 wherein said implementing instructions further comprise instructions determining an equipment configuration of roadway equipment to display information and instructions to direct motorists in alternative traffic routes to avoid congestion on the roadway on which the vehicles are traveling.

6. The computer program product as described in claim 5 wherein said implementing instructions further comprise instructions automatically switching roadway equipment to direct motorists in alternative traffic routes to avoid congestion on the roadway on which the vehicles are traveling.

* * * * *